US006626108B2

(12) United States Patent
Lewis

(10) Patent No.: US 6,626,108 B2
(45) Date of Patent: Sep. 30, 2003

(54) LITHOGRAPHIC IMAGING WITH METAL-BASED, NON-ABLATIVE WET PRINTING MEMBERS

(75) Inventor: Thomas E. Lewis, East Hampstead, NH (US)

(73) Assignee: Presstek Inc., Hudson, NH (US)

( * ) Notice: Subject to any disclaimer, the term of this patent is extended or adjusted under 35 U.S.C. 154(b) by 0 days.

(21) Appl. No.: 10/047,310

(22) Filed: Jan. 15, 2002

(65) Prior Publication Data

US 2002/0092437 A1 Jul. 18, 2002

Related U.S. Application Data

(62) Division of application No. 09/564,898, filed on May 3, 2000, now Pat. No. 6,378,432.

(51) Int. Cl.[7] ..... B41C 1/10; B41N 1/08

(52) U.S. Cl. ..... 101/467; 101/457

(58) Field of Search ..... 101/454, 457, 101/462, 463.1, 465, 466, 467; 430/302

(56) References Cited

U.S. PATENT DOCUMENTS

| | | | | | |
|---|---|---|---|---|---|
| 5,339,737 | A | | 8/1994 | Lewis et al. | 101/454 |
| 5,417,164 | A | * | 5/1995 | Nishida et al. | 101/453 |
| 5,493,971 | A | | 2/1996 | Lewis et al. | 101/454 |
| 5,570,636 | A | | 11/1996 | Lewis | 101/454 |
| 5,691,063 | A | | 11/1997 | Davis et al. | 101/457 |
| 5,819,661 | A | * | 10/1998 | Lewis et al. | 101/467 |
| 5,868,074 | A | | 2/1999 | Neifert et al. | 101/462 |
| 5,985,515 | A | | 11/1999 | Van Rompuy et al. | 430/302 |
| 5,996,498 | A | * | 12/1999 | Lewis | 101/467 |
| 6,085,656 | A | * | 7/2000 | Lewis | 101/460 |
| 6,107,001 | A | * | 8/2000 | Lewis et al. | 430/302 |
| 6,145,565 | A | | 11/2000 | Fromson et al. | 101/457 |
| 6,168,903 | B1 | * | 1/2001 | Cassidy et al. | 430/302 |
| 6,182,569 | B1 | | 2/2001 | Rorke et al. | 101/457 |
| 6,182,570 | B1 | | 2/2001 | Rorke et al. | 101/462 |
| 6,186,067 | B1 | | 2/2001 | Rorke et al. | 101/467 |
| 6,192,798 | B1 | | 2/2001 | Rorke et al. | 101/457 |
| 6,207,349 | B1 | | 3/2001 | Lewis | 430/302 |
| 6,251,334 | B1 | | 6/2001 | Lewis | 264/517 |
| 6,300,040 | B1 | * | 10/2001 | Lewis | 430/302 |
| 6,374,738 | B1 | * | 4/2002 | Lewis et al. | 101/467 |
| 6,378,432 | B1 | | 4/2002 | Lewis | 101/467 |

FOREIGN PATENT DOCUMENTS

| | | |
|---|---|---|
| EP | 0 862 998 A1 | 9/1998 |
| EP | 1 088 653 A2 | 4/2001 |
| WO | WO 97/06956 | 2/1997 |
| WO | WO 98/50231 | 11/1998 |
| WO | WO 99/37481 | 7/1999 |
| WO | WO 99/37482 | 7/1999 |
| WO | WO 02/01291 | 1/2002 |
| WO | WO 02/072058 A1 | 9/2002 |

* cited by examiner

*Primary Examiner*—Stephen R. Funk
(74) *Attorney, Agent, or Firm*—Testa, Hurwitz & Thibeault, LLP

(57) ABSTRACT

Lithographic imaging using non-ablative printing members combines the benefits of simple construction, the ability to utilize traditional metal base supports, and amenability to imaging with low-power lasers that need not impart ablation-inducing energy levels. A representative printing member has a hydrophilic metal substrate and, thereover, first and second layers. The first layer has a thickness and an exposed surface and comprises a material that absorbs imaging radiation. The second layer overlies the first layer and is oleophilic and substantially transparent to imaging radiation. Exposure to imaging radiation causes the first layer and the substrate to irreversibly detach without substantial ablation, thereby facilitating removal, by subjection to the cleaning liquid, of the first and second layers where detachment has taken place.

13 Claims, 4 Drawing Sheets

LITHOGRAPHIC IMAGING WITH METAL-BASED, NON-ABLATIVE WET PRINTING MEMBERS

CROSS-REFERENCE TO RELATED APPLICATIONS

This is a division of U.S. Ser. No. 09/564,898, filed May 3, 2000, now U.S. Pat. No. 6,378,432, the entire disclosure of which is incorporated by reference herein.

FIELD OF THE INVENTION

The present invention relates to digital printing apparatus and methods, and more particularly to imaging of lithographic printing-plate constructions on- or off-press using digitally controlled laser output.

BACKGROUND OF THE INVENTION

In offset lithography, a printable image is present on a printing member as a pattern of ink-accepting (oleophilic) and ink-rejecting (oleophobic) surface areas. Once applied to these areas, ink can be efficiently transferred to a recording medium in the imagewise pattern with substantial fidelity. Dry printing systems utilize printing members whose ink-repellent portions are sufficiently phobic to ink as to permit its direct application. Ink applied uniformly to the printing member is transferred to the recording medium only in the imagewise pattern. Typically, the printing member first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

In a wet lithographic system, the non-image areas are hydrophilic, and the necessary ink-repellency is provided by an initial application of a dampening fluid to the plate prior to inking. The dampening fluid prevents ink from adhering to the non-image areas, but does not affect the oleophilic character of the image areas.

To circumvent the cumbersome photographic development, plate-mounting and plate-registration operations that typify traditional printing technologies, practitioners have developed electronic alternatives that store the imagewise pattern in digital form and impress the pattern directly onto the plate. Plate-imaging devices amenable to computer control include various forms of lasers.

For example, U.S. Pat. No. 5,493,971 discloses wet-plate constructions that extend the benefits of ablative laser imaging technology to traditional metal-based plates. Such plates remain the standard for most of the long-run printing industry due to their durability and ease of manufacture. As shown in FIG. 1, a lithographic printing construction 100 in accordance with the '971 patent includes a grained-metal substrate 102, a protective layer 104 that can also serve as an adhesion-promoting primer, and an ablatable oleophilic surface layer 106. In operation, imagewise pulses from an imaging laser (typically emitting in the near-infrared, or "IR" spectral region) interact with the surface layer 106, causing ablation thereof and, probably, inflicting some damage to the underlying protective layer 104 as well. The imaged plate 100 may then be subjected to a solvent that eliminates the exposed protective layer 104, but which does no damage either to the surface layer 106 or the unexposed protective layer 104 lying thereunder. By using the laser to directly reveal only the protective layer and not the hydrophilic metal layer, the surface structure of the latter is fully preserved; the action of the solvent does no damage to this structure.

A related approach is disclosed in published PCT Application Nos. US99/01321 and US99/01396. A printing member in accordance with this approach, representatively illustrated at 200 in FIG. 2, has a grained metal substrate 202, a hydrophilic layer 204 thereover, an ablatable layer 206, and an oleophilic surface layer 208. Surface layer 208 is transparent to imaging radiation, which is concentrated in layer 206 by virtue of that layer's intrinsic absorption characteristics and also due to layer 204, which provides a thermal barrier that prevents heat loss into substrate 202. As the plate is imaged, ablation debris is confined beneath surface layer 208; and following imaging, those portions of surface layer 208 overlying imaged regions are readily removed. Because layer 204 is hydrophilic and survives the imaging process, it can serve the printing function normally performed by grained aluminum, namely, adsorption of fountain solution.

Both of these constructions rely on removal of the energy-absorbing layer to create an image feature. Exposure to laser radiation may, for example, cause ablation—i.e., catastrophic overheating-of the ablated layer in order to facilitate its removal. Accordingly, the laser pulse must transfer substantial energy to the absorbing layer. This means that even low-power lasers must be capable of very rapid response times, and imaging speeds (i.e., the laser pulse rate) must not be so fast as to preclude the requisite energy delivery by each imaging pulse.

DESCRIPTION OF THE INVENTION

Brief Summary of the Invention

The present invention obviates the need for substantial ablation as an imaging mechanism, combining the benefits of simple construction, the ability to utilize traditional metal base supports, and amenability to imaging with low-power lasers that need not impart ablation-inducing energy levels. In preferred embodiments, the invention utilizes a printing member having a topmost layer that is ink-receptive and a hydrophilic metal substrate. The topmost layer does not significantly absorb imaging radiation, but an intermediate layer disposed between the topmost layer and the metal substrate does absorb imaging radiation. In one version, in response to an imaging pulse, the absorbing layer debonds from the surface of the adjacent metal substrate; in another version, an interior split is formed within the absorbing layer, facilitating removal of the portion of that layer above the split. In neither case does the absorbing layer undergo substantial ablation.

It must be stressed that it is ordinarily impractical or even impossible to image, by ablation, constructions in which an absorbing layer directly overlies the metal substrate. This is because because the thick metal substrate acts as a heat sink, drawing laser energy needed to heat the absorbing layer to achieve imaging. Because ablation is not involved as an imaging mechanism in the present invention, however, this condition is avoided. Sufficient energy is concentrated in the upper portions of the absorbing-layer thickness to cause debonding notwithstanding heat transport into the metal substrate. It is also possible to create an absorber gradient within the absorbing layer, with the absorber concentration diminishing from the top of the layer to the bottom, so that the surface in contact with the metal substrate has very little absorber. This concentration gradient further discourages transfer of heat to the metal substrate while preserving sufficient overall absorption and heating to effect interfacial debonding. Indeed, some transfer of heat to the metal substrate (as well as to an overlying layer, when present) is desirable to avoid unintended ablation of the absorbing layer, which can result in production of unwanted volatile debris.

In use, the printing member is selectively exposed to laser radiation in an imagewise pattern. Where the printing member has received laser exposure—that is, where the substrate and absorbing layer have been detached from each other—remnants of the absorbing layer and the overlying layer (or layers) is readily removed by post-imaging cleaning (see, e.g., U.S. Pat. Nos. 5,540,150; 5,870,954; 5,755,158; and 5,148,746) to produce a finished printing place.

Accordingly, layers that would otherwise undergo complete destruction as a consequence of ablation imaging are retained in the present constructions, and serve as highly durable layers that participate in the printing process. Key to the present invention, then, is irreversible detachment between layers caused by heating, without ablation, of a radiation-absorptive layer, and an absorber concentration gradient that prevents excessive energy dissipation from the absorbing layer.

The plates of the present invention are "positive-working" in the sense that inherently ink-receptive areas receive laser output and are ultimately removed, revealing the hydrophilic layer that will reject ink during printing; in other words, the "image area" is selectively removed to reveal the "background." Such plates are also referred to as "indirect-write."

It should be noted that, as used herein, the term "plate" or "member" refers to any type of printing member or surface capable of recording an image defined by regions exhibiting differential affinities for ink and/or fountain solution; suitable configurations include the traditional planar or curved lithographic plates that are mounted on the plate cylinder of a printing press, but can also include seamless cylinders (e.g., the roll surface of a plate cylinder), an endless belt, or other arrangement.

Furthermore, the term "hydrophilic" is used in the printing sense to connote a surface affinity for a fluid which prevents ink from adhering thereto. Such fluids include water for conventional ink systems, aqueous and non-aqueous dampening liquids, and the non-ink phase of single-fluid ink systems. Thus, a hydrophilic surface in accordance herewith exhibits preferential affinity for any of these materials relative to oil-based materials.

BRIEF DESCRIPTION OF THE DRAWINGS

The foregoing discussion will be understood more readily from the following detailed description of the invention, when taken in conjunction with the accompanying drawings, in which.

Figure 1:
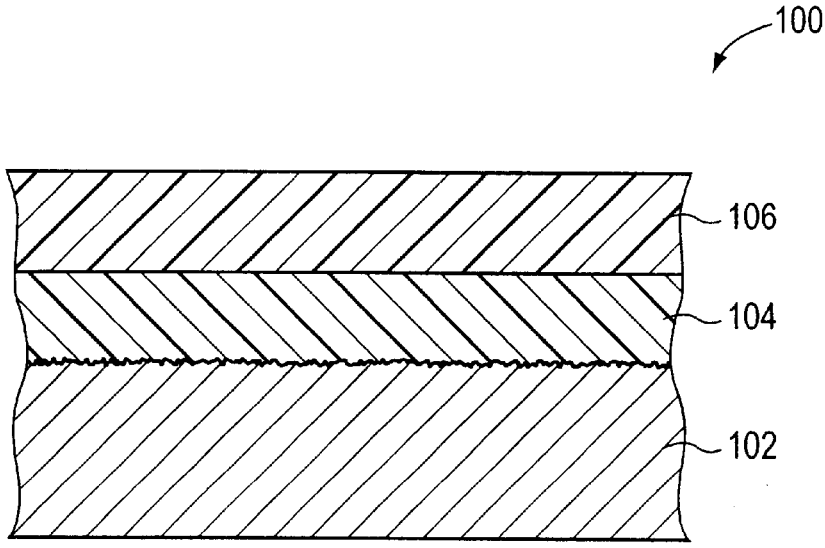
FIG. 1 (PRIOR ART)
FIGS. 1 and 2 are enlarged sectional views of prior-art printing members.
Figure 2:
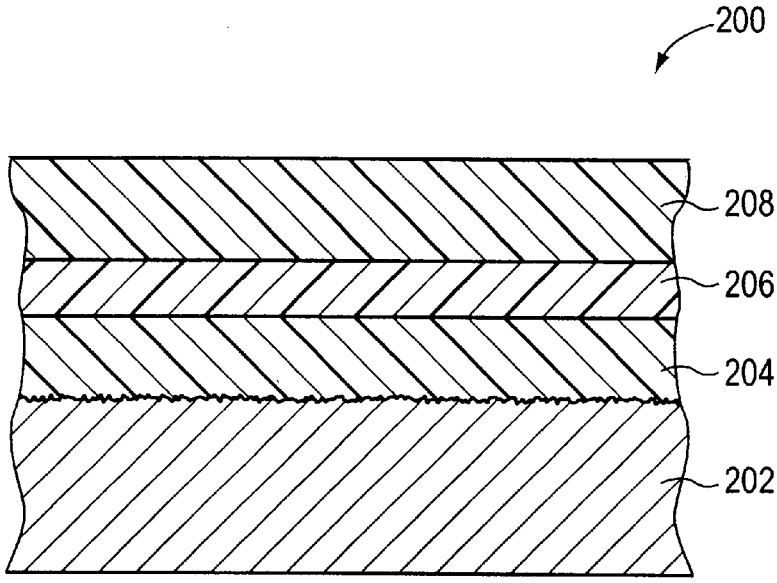
FIG. 2 (PRIOR ART)

The drawings and elements thereof may not be drawn to scale.

DETAILED DESCRIPTION OF THE PREFERRED EMBODIMENTS

Imaging apparatus suitable for use in conjunction with the present printing members includes at least one laser device that emits in the region of maximum plate responsiveness, i.e., whose $\lambda_{max}$ closely approximates the wavelength region where the plate absorbs most strongly. Specifications for lasers that emit in the near-IR region are fully described in U.S. Pat. Nos. Re. 35,512 and 5,385,092 (the entire disclosures of which are hereby incorporated by reference); lasers emitting in other regions of the electromagnetic spectrum are well-known to those skilled in the art.

Suitable imaging configurations are also set forth in detail in the '512 and '092 patents. Briefly, laser output can be provided directly to the plate surface via lenses or other beam-guiding components, or transmitted to the surface of a blank printing plate from a remotely sited laser using a fiber-optic cable. A controller and associated positioning hardware maintain the beam output at a precise orientation with respect to the plate surface, scan the output over the surface, and activate the laser at positions adjacent selected points or areas of the plate. The controller responds to incoming image signals corresponding to the original document or picture being copied onto the plate to produce a precise negative or positive image of that original. The image signals are stored as a bitmap data file on a computer. Such files may be generated by a raster image processor ("RIP") or other suitable means. For example, a RIP can accept input data in page-description language, which defines all of the features required to be transferred onto the printing plate, or as a combination of page-description language and one or more image data files. The bitmaps are constructed to define the hue of the color as well as screen frequencies and angles.

Other imaging systems, such as those involving light valving and similar arrangements, can also be employed; see, e.g., U.S. Pat. Nos. 4,577,932; 5,517,359; 5,802,034; and 5,861,992, the entire disclosures of which are hereby incorporated by reference. Moreover, it should also be noted that image spots may be applied in an adjacent or in an overlapping fashion.

The imaging apparatus can operate on its own, functioning solely as a platemaker, or can be incorporated directly into a lithographic printing press. In the latter case, printing may commence immediately after application of the image to a blank plate, thereby reducing press set-up time considerably. The imaging apparatus can be configured as a flatbed recorder or as a drum recorder, with the lithographic plate blank mounted to the interior or exterior cylindrical surface of the drum. Obviously, the exterior drum design is more appropriate to use in situ, on a lithographic press, in which case the print cylinder itself constitutes the drum component of the recorder or plotter.

In the drum configuration, the requisite relative motion between the laser beam and the plate is achieved by rotating the drum (and the plate mounted thereon) about its axis and moving the beam parallel to the rotation axis, thereby scanning the plate circumferentially so the image "grows" in the axial direction. Alternatively, the beam can move parallel to the drum axis and, after each pass across the plate, increment angularly so that the image on the plate "grows" circumferentially. In both cases, after a complete scan by the beam, an image corresponding (positively or negatively) to the original document or picture will have been applied to the surface of the plate.

In the flatbed configuration, the beam is drawn across either axis of the plate, and is indexed along the other axis after each pass. Of course, the requisite relative motion between the beam and the plate may be produced by movement of the plate rather than (or in addition to) movement of the beam.

Regardless of the manner in which the beam is scanned, in an array-type system it is generally preferable (for on-press applications) to employ a plurality of lasers and guide their outputs to a single writing array. The writing array is then indexed, after completion of each pass across or along the plate, a distance determined by the number of beams emanating from the array, and by the desired resolution (i.e., the number of image points per unit length). Off-press applications, which can be designed to accommodate very rapid scanning (e.g., through use of high-speed motors, mirrors, etc.) and thereby utilize high laser pulse rates, can frequently utilize a single laser as an imaging source.

With reference to FIGS. 3 and 4A–4C, a representative embodiment of a lithographic printing member in accordance herewith includes a metal substrate 302, a radiation-absorptive layer 304, and an oleophilic layer 306 that is substantially transparent to imaging radiation. Layer 306 is optional, however, and the construction may be limited to a metal substrate 302 and an oleophilic, radiation-absorptive layer 304.

1. Substrate 302

The primary function of substrate 302 is to provide dimensionally stable mechanical support, and possibly to dissipate heat accumulated in layer 304 to prevent its ablation. Suitable substrate materials include, but are not limited to, alloys of aluminum and steel (which may have another metal such as copper plated over one surface). Preferred thicknesses range from 0.004 to 0.02 inch, with thicknesses in the range 0.005 to 0.012 inch being particularly preferred.

Substrate 302 has a hydrophilic surface. In general, metal layers must undergo special treatment in order to be capable of accepting fountain solution in a printing environment. Any number of chemical or electrical techniques, in some cases assisted by the use of fine abrasives to roughen the surface, may be employed for this purpose. For example, electrograining involves immersion of two opposed aluminum plates (or one plate and a suitable counterelectrode) in an electrolytic cell and passing alternating current between them. The result of this process is a finely pitted surface topography that readily adsorbs water. See, e.g., U.S. Pat. No. 4,087,341.

A structured or grained surface can also be produced by controlled oxidation, a process commonly called "anodizing." An anodized aluminum substrate consists of an unmodified base layer and a porous, "anodic" aluminum oxide coating thereover; this coating readily accepts water. However, without further treatment, the oxide coating would lose wettability due to further chemical reaction. Anodized plates are, therefore, typically exposed to a silicate solution or other suitable (e.g., phosphate) reagent that stabilizes the hydrophilic character of the plate surface. In the case of silicate treatment, the surface may assume the properties of a molecular sieve with a high affinity for molecules of a definite size and shape—including, most importantly, water molecules. The treated surface also promotes adhesion to an overlying photopolymer layer. Anodizing and silicate treatment processes are described in U.S. Pat. Nos. 3,181,461 and 3,902,976.

Preferred hydrophilic substrate materials include aluminum that has been mechanically, chemically, and/or electrically grained with or without subsequent anodization. In addition, some metal layers need only be cleaned, or cleaned and anodized, to present a sufficiently hydrophilic surface. A hydrophilic surface is easier to coat with layer 304, and provides better adhesion to that layer.

2. Layer 304

Figure 3:
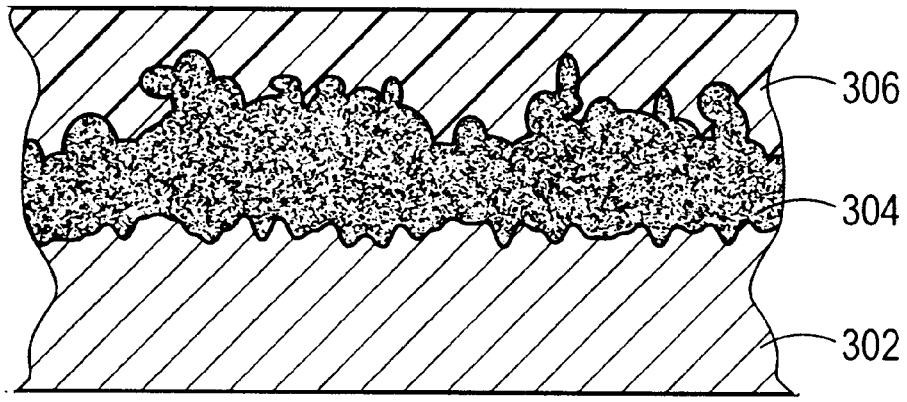
FIG. 3 is an enlarged sectional view of a positive-working lithographic printing member having a uniform absorber concentration.
Figure 4A:
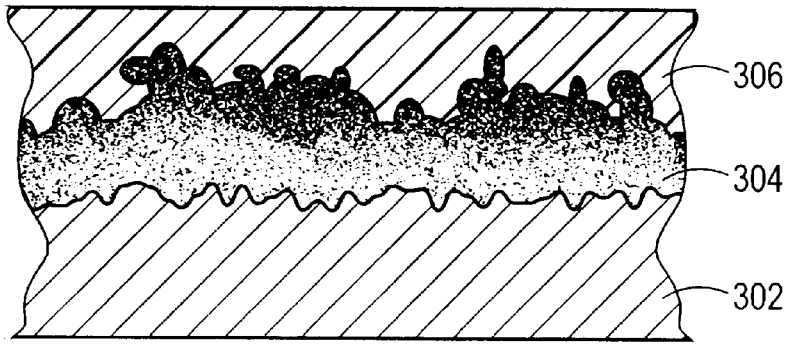
FIGS. 4A–4C are an enlarged sectional views of a positive-working, graded-absorber lithographic printing member in the unimaged, imaged, and cleaned states, respectively.

Layer 304 absorbs imaging radiation to cause irreversible detachment from metal layer 302. The layer may contain a uniform dispersion of a radiation absorber, as shown in FIG. 3, or a dispersion graded in concentration from the top to the bottom of its thickness as shown in FIG. 4A.

Preferred base materials for layer 304 are polymeric and capable of receiving a radiation absorber (if desired, in a graded fashion). Accordingly, the primary considerations in choosing a material for layer 304 relate to fabrication and manufacturability. Formulations based on polyvinyl alcohol respond to solvents or saturants, which allow the absorber to penetrate the layer 304 even after it has been applied and cured. The degree of cross-linking within layer 304 may be controlled in order to enhance this property.

Thus, layer 304 may comprise a polymer and a crosslinking agent. Suitable hydrophilic polymers for layer 304 include, but are not limited to, polyvinyl alcohol and cellulosics. In a preferred embodiment, the hydrophilic polymer is polyvinyl alcohol. In one version thereof, the crosslinking agent is a zirconium compound, preferably ammonium zirconyl carbonate. Suitable polyvinyl alcohol-based coatings for use in connection with this layer include, but are not limited to, combinations of AIRVOL 325 polyvinyl alcohol; BACOTE 20, an ammonium zirconyl carbonate solution available from Magnesium Elektron, Flemington, N.J., in combination with additives such as humectants to modify the rewettability of the coating following application. Suitable additives include glycerol; pentaerythritol; glycols such as ethylene glycol, diethylene glycol, trimethylene diglycol, and propylene glycol; citric acid, glycerophosphoric acid; sorbitol; gluconic acid; and TRITON X-100, a surfactant available from Rohm & Haas, Philadelphia, Pa. Typical amounts of BACOTE 20 utilized in crosslinking polymers are less than 5 wt % of the weight of the polymers, as described, for example, in "The Use of Zirconium in Surface Coatings," Application Information Sheet 117 (Provisional), by P. J. Moles, Magnesium Electron, Inc., Flemington, N.J. Surprisingly, it has been found that significantly increased levels of BACOTE 20, such as 40 wt % of the polyvinyl alcohol polymer, provide significant improvements in the ease of cleaning the laser-exposed areas, in the durability and adhesion during long press runs, and in the fine image resolution and printing quality that can be achieved. The high levels of BACOTE 20 also provide a layer 304 that interacts with a subsequent coating application of an overlying layer 306 (or a primer layer) as discussed below. In one embodiment, layer 304 comprises ammonium zirconyl carbonate in an amount greater than 10 wt % based on the total weight of the polymers present in the hydrophilic third layer. Zirconyl carbonate may, for example, be present in an amount of 5 to 100 wt % based on the total weight of polymers present in layer 304.

Other suitable coatings include copolymers of polyvinyl alcohol with polyvinyl pyrrolidone (PVP), and copolymers of polyvinylether (PVE) including polyvinylether/maleic anhydride versions.

Layer 304 is coated in this invention typically at a thickness in the range of from about 1 to about 40 $\mu$m and more preferably in the range of from about 1 to about 5 $\mu$m.

After coating, the layer is dried and subsequently cured at a temperature between 135° C. and 185° C. for between 10 sec and 3 min and more preferably at a temperature between 145° C. and 165° C. for between 30 sec and 2 min.

For uniform absorber distributions, the absorber is introduced and dispersed into the polymer or polymer precursor prior to curing. By contrast, to achieve a graded concentration, the absorber is typically introduced into layer 304 after the latter is cured. Essentially, the absorber is dissolved or dispersed within a carrier that will uniformly wet the surface of layer 304. The absorber mixture, which may also contain wetting and/or leveling agents, is coated onto the exposed surface of layer 304 and allowed to impregnate the layer. The cross-linking of layer 304 acts as an imperfect barrier to penetration that creates a concentration gradient in which the absorber concentrated toward the upper portion of the layer. A porous polymeric structure, such as that obtained with the zirconia-filled BACOTE 20 material, is desirable in this regard. It should be emphasized that the applied absorber becomes part of layer 304 (its concentration decreasing with depth), and to does not persist as a separate layer.

In the case of IR or near-IR imaging radiation, suitable absorbers include a wide range of dyes and pigments, such as carbon black; nigrosine-based dyes; phthalocyanines (e.g., aluminum phthalocyanine chloride, titanium oxide phthalocyanine, vanadium (IV) oxide phthalocyanine, and the soluble phthalocyanines supplied by Aldrich Chemical Co., Milwaukee, Wis.); naphthalocyanines (see, e.g., U.S. Pat. Nos. 4,977,068; 4,997,744; 5,023,167; 5,047,312; 5,087,390; 5,064,951; 5,053,323; 4,723,525; 4,622,179; 4,492,750; and 4,622,179); iron chelates (see, e.g., U.S. Pat. Nos. 4,912,083; 4,892,584; and 5,036,040); nickel chelates (see, e.g., U.S. Pat. Nos. 5,024,923; 4,921;317; and 4,913,846); oxoindolizines (see, e.g., U.S. Pat. No. 4,446,223); iminium salts (see, e.g., U.S. Pat. No. 5,108,873); and indophenols (see, e.g., U.S. Pat. No. 4,923,638); TiON, TiCN, tungsten oxides of chemical formula $WO_{3-x}$, where $0<x<0.5$ (with $2.7<x<2.9$ being preferred); and vanadium oxides of chemical formula $V_2O_{5-x}$, where $0<x<1.0$ (with $V_6O_{13}$ being preferred). Pigments are typically utilized in the form of aqueous or solvent dispersions.

The absorption sensitizer should minimally affect adhesion between layer 304 and any overlying layer (as discussed below). Surface-modified carbon-black pigments sold under the trade designation CAB-O-JET 200 by Cabot Corporation, Bedford, Mass. are found to minimally disrupt adhesion at loading levels providing adequate sensitivity for heating. The CAB-O-JET series of carbon black products are unique aqueous pigment dispersions made with novel surface modification technology, as, for example, described in U.S. Pat. Nos. 5,554,739 and 5,713,988. Pigment stability is achieved through ionic stabilization. No surfactants, dispersion aids, or polymers are typically present in the dispersion of the CAB-O-JET materials. CAB-O-JET 200 is a black liquid, having a viscosity of less than about 10 cP (Shell #2 efflux cup); a pH of about 7; 20% (based on pigment) solids in water; a stability (i.e., no change in any physical property) of more than 3 freeze-thaw cycles at −20° C., greater than six weeks at 70° C., and more than 2 yr at room temperature; and a mean particle size of 0.12 $\mu$m, with 100% of the particles being less than 0.5 $\mu$m. Significantly, CAB-O-JET 200 also absorbs across the entire infrared spectrum, as well as across the visible and ultraviolet regions.

BONJET BLACK CW-1, a surface-modified carbon-black aqueous dispersion available from Orient Corporation, Springfield, N.J., also resulted in adhesion to the hydrophilic layer 304 at the amounts required to give adequate sensitivity for ablation.

Other near-IR absorbers for absorbing layers based on polyvinyl alcohol include conductive polymers, e.g., polyanilines, polypyrroles, poly-3,4-ethylenedioxypyrroles, polythiophenes, and poly-3,4-ethylenedioxythiophenes. These can be applied to layer 304 subsequent to the curing process; see, e.g., U.S. Pat. No. 5,908,705. For conductive polymers based on polypyrroles, the catalyst for polymerization conveniently provides the "dopant" that establishes conductivity.

Suitable coatings may be formed by known mixing and coating methods, for example, wherein a base coating mix is formed by first mixing the various components, delaying the addition of cross-linking agents to the base coating mix or dispersion just prior to the coating application. The coating mix or dispersion may be applied by any of the known methods of coating application, such as, for example, wire-wound rod coating, reverse-roll coating, gravure coating, or slot-die coating. After drying to remove the volatile liquids, a solid coating layer is formed.

Exemplary saturating dispersions for impregnation into a suitable layer 304 are as follows.

| Component (parts by weight) | Example 1 (Pigment Dispersion) | Example 2 (Dye Dispersion) |
|---|---|---|
| BONJET Black CW-1 | 20.0 | — |
| Water | 100.0 | — |
| TRITON X-100 | 0.2 | — |
| Methyl ethyl ketone | — | 100.0 |
| IR 810 | — | 1.5 |

IR 810 refers to the IR-absorbing oxyindolizine dye ($\lambda_{max}$= 810 nm) described in U.S. Pat. No. 4,948,778, the entire disclosure of which is hereby incorporated by reference.

For each of Examples 1 and 2, the formulation is applied to a suitable coating, such as the following exemplary polyvinyl alcohol-based coating, following cure. The following coating is cured by drying for 2 min at 300° F.

| Component (parts by weight) | Example 3 |
|---|---|
| AIRVOL 125 | 9.0 |
| Water | 187.8 |
| BACOTE 20 | 3.0 |
| TRITON X-100 | 0.2 |

Figure 4B:
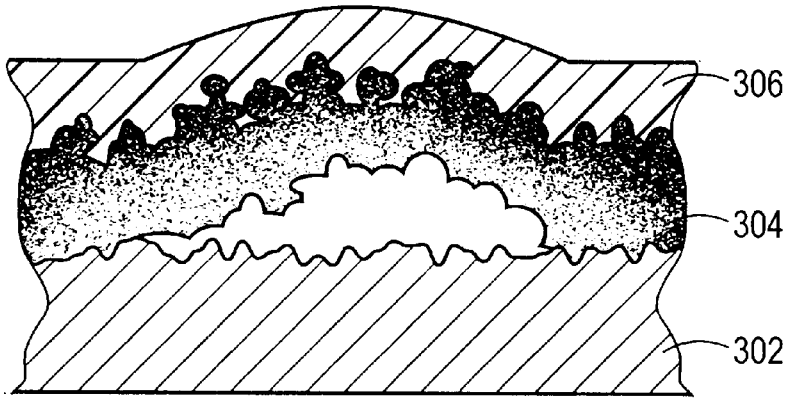
Figure 4C:
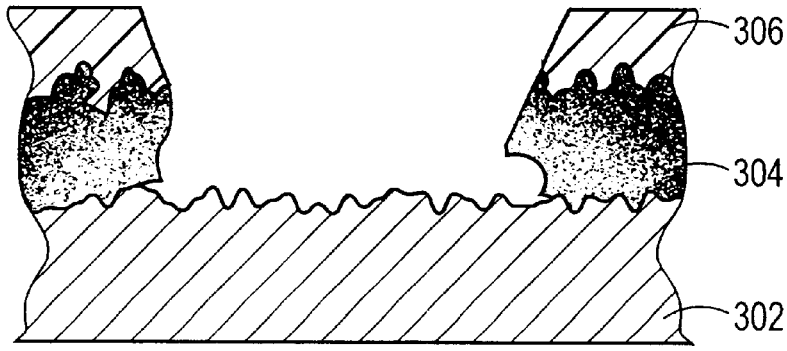

As shown in FIGS. 4B and 4C, exposure of layer 304 to an imaging pulse (either directly or, as depicted, through a transparent layer 306) causes layer 304 to irreversibly detach from the hydrophilic surface of substrate 302 (FIG. 3B). The detched region may be removed by any suitable post-image cleaning process, with the result that the surface of layer 302 is exposed. Layer 304 (or, if used, layer 306) is oleophilic, providing the necessary affinity difference to support lithographic printing.

Figure 5A:
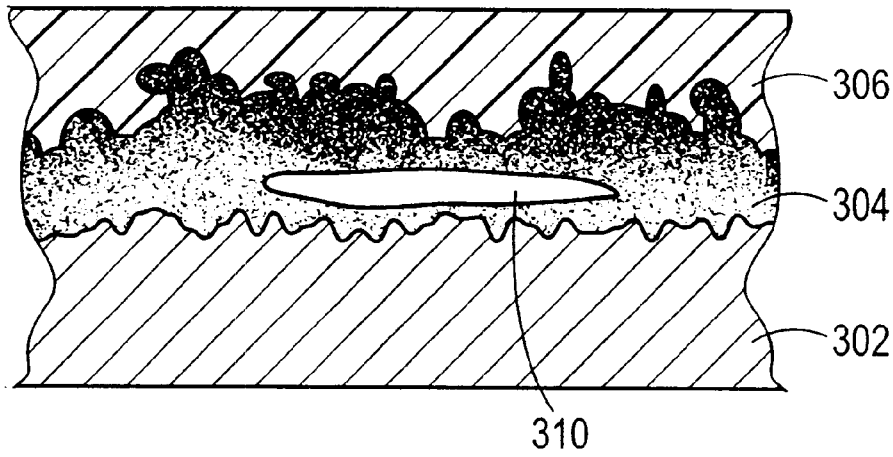
FIGS. 5A and 5B illustrate imaging of the printing member of FIG. 4A so as to produce an interior split.
Figure 5B:
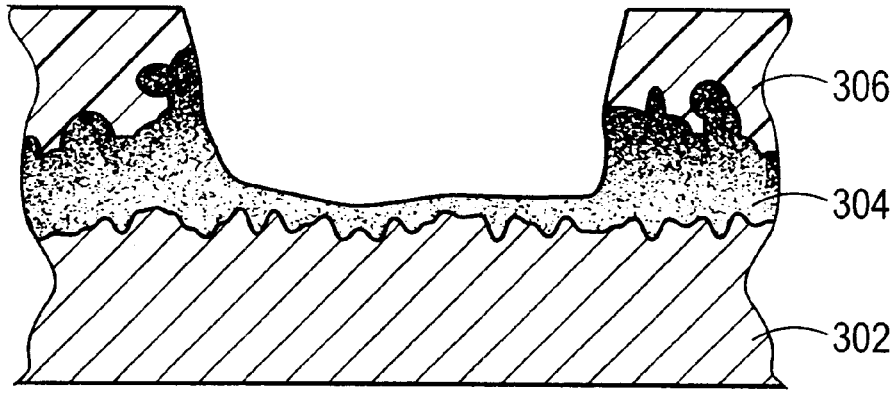

Alternatively, as shown in FIGS. 5A and 5B, exposure of the printing member to imaging radiation may create an interior split 310. This mechanism can be advantageous in that, following cleaning, a remnant of layer 304 remains over the surface of substrate 302. That surface is typically vulnerable to environmental damage that decreases hydrophilic response, so that overlying remnant affords stabilization. So long as layer 304 is hydrophilic, it will function as the lithographic equivalent of the substrate surface (throughout the useful life of the printing member or until worn away to expose the substrate surface). Finally, if layer 304 is colored, the low absorber concentration at the bottom of the layer thickness allow this color to be observed. Where layer 304 has not received imaging radiation, the color will be overwhelmed by the dark absorber concentrated at the top of the layer, resulting in useful contrast between imaged and unimaged portions of the printing member.

With reference to the alternative embodiment shown in FIG. 3, which utilizes a uniform dispersion of absorber through layer 304, an exemplary formulation is as follows:

| Component (parts by weight) | Example 4 |
|---|---|
| AIRVOL 125 | 8.5 |
| Water | 167.5 |
| BACOTE 20 | 14.0 |
| BONJET CW-1 | 40.0 |
| TRITON X-100 | 0.2 |

The BACOTE 20 is utilized as supplied with 20% $ZrO_2$ content. A useful application weight is 1.7 g/m$^2$.

Key to the present invention is the resistance of layer 304 to reattachment to substrate 302. Following separation, layer 304 and substrate 302 remain separated, and layer 304—whether detached or internally split—does not undergo substantial ablation. (By "substantial ablation" is meant destruction of 75% or more of the bulk of layer 304.)

Unlike ablation systems, in which the heating layer is destroyed by imaging radiation, the present invention requires the heat accumulating in that layer to merely cause detachment from the underlying substrate. The heated layer persists following imaging and participates in the printing process.

In considering present approach against ablation-type systems, it should be recognized that heating a multi-layer recording construction having a heat-sensitive layer can produce any of five results: (1) if insufficient heating energy is applied, the heated layer will be unaffected; (2) if the layers of the recording material are not well-chosen, the heated layer may become hot, but may not cause interlayer detachment; (3) if the layers of the recording material are not well-chosen, the heated layer may detach from the substrate, but it will then reattach; (4) if the layers of the recording material are properly chosen, the heated layer may detach from the substrate and remain detached; or (5) if a substantial quantity of energy is applied, the heat-sensitive layer may be ablated.

The present invention concerns only the fourth possibility. Accordingly, the proper amount of energy must be delivered to cause the desired behavior. This, in turn, is a function of parameters such as laser power, the duration of the pulse, the intrinsic absorption of the heat-sensitive layer (as determined, for example, by the concentration of absorber therein), the thickness of the heat-sensitive layer, and the presence of a thermally conductive layer beneath the heat-sensitive layer. These parameters are readily determined by the skilled practitioner without undue experimentation. It is possible, for example, to cause the same materials to undergo ablation or to simply become heated without damage.

3. Surface Layer 306

Layer 306 accepts ink and is substantially transparent to imaging radiation. By "substantially transparent" is meant that the layer does not significantly absorb in the relevant spectral region, i.e., passes at least 90% of incident imaging radiation. Important characteristics of ink-accepting surface layer 306 include oleophilicity and hydrophobicity, resistance to solubilization by water and solvents, and durability when used on a printing press. Suitable polymers utilized in this layer should have excellent adhesion to layer 304 and high wear resistance. They can be either water-based or solvent-based polymers. Any decomposition byproducts produced by ink-accepting surface layer 306 should be environmentally and toxicologically innocuous. This layer also may include a crosslinking agent which provides improved bonding to layer 304 and increased durability of the plate for extremely long print runs.

The following are working examples of layer 306:

| Component (parts by weight) | Example 5 (SiH-Based) | Example 6 (Cross-linked Nitrocellulose) | Example 7 (Colored) |
|---|---|---|---|
| PS-120 | 10.0 | — | — |
| Heptane | 189.8 | — | — |
| PC-072 | 0.2 | — | — |
| 5-6 Sec RS nitrocellulose | — | 10.0 | 10.0 |
| CYMEL 303 | — | 2.0 | 2.0 |
| NACURE 2530 | — | 4.0 | 4.0 |
| Methyl ethyl ketone | — | 148.0 | 146.5 |
| N-propyl acetate | — | 35.0 | 35.0 |
| Victoria Blue BO | — | — | 1.5 |

PS-120 is a polymethylhydrosiloxane cross-linking agent and PC-072 is a platinum-divinyltetramethyldisiloxane catalyst, both marketed by Huls. NaCure 2530, supplied by King Industries, Norwalk, Conn., is an amine-blocked p-toluenesulfonic acid solution in an isopropanol/methanol blend.

Any of the above coatings may be applied to a cured layer 304 (after any absorber impregnation), following which it is then cured.

Example 5 is optimal for coating over uniform layer 304 as described in Example 4. Cast and cured on this layer 304 or that described in Examples 1/3, the result is a black image on a light gray background (the color of the lithographic aluminum substrate 302). It is found that the layer 304 of Example 5 does not interact well with the dye-based construction of Examples 2/3. Example 6 may be cast and cured on layer 304 in accordance with Examples 1/3, but produces a light olive green image on a light gray background that may be difficult to assess for quality. Example 7, however, cast and cured on the formulation of Examples 1/3 provides a bright blue image easily distinguished over a gray background.

Numerous variations on these approaches are possible. For example, using lithographic aluminum as substrate 302, it is possible to apply, dry and cure a polyvinyl alcohol/BACOTE 20 coating containing NACURE 2530. The result is a hydrophilic coating containing free PTSA (p-toluene sulfonic acid); the amines used to neutralize the PTSA volatilize during drying and curing. A solution containing pyrrole monomer may be applied to the coating to impregnate it with an IR absorber. The free PTSA provides a catalyst (and anion) for in situ polypyrrole formation. The result is a near-IR absorbing, conductive polymer formed within the polyvinyl alcohol/BACOTE 20 layer.

One can then apply a durable, hydrophobic (oleophilic/melanophilic) overcoat 306 to provide an ink-receptive surface. Like the other printing members described above, the resulting plate is designed for positive imaging and conventional printing (dampening fluid) including single-fluid inks.

It will therefore be seen that the foregoing techniques provide a basis for improved lithographic printing and superior plate constructions. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A method of imaging a lithographic printing member, the method comprising the steps of:

a. providing a printing member having a hydrophilic metal substrate and, thereover, first and second layers, wherein (i) the first layer has a thickness and an exposure surface and comprises a material that absorbs imaging radiation, and (ii) the second layer overlies the first layer and is oleophilic and substantially transparent to imaging radiation;

b. selectively exposing the printing member to laser radiation in an imagewise pattern, laser energy being absorbed by the first layer where so exposed so as to heat the first layer and cause formation of an interior split within the thickness thereof; and c. removing remnants of the second layer and the first layer above the interior split where the printing member received radiation, thereby creating an imagewise lithographic pattern on the printing member.

2. The method of claim 1 wherein the absorbing material is distributed uniformly through the thickness of the first layer.

3. The method of claim 1 wherein the absorbing material is a pigment.

4. The method of claim 1 wherein the absorbing material is a dye.

5. The method of claim 1 wherein the absorbing material is a conductive polymer.

6. The method of claim 1 wherein the first layer comprises a polyvinyl alcohol chemical species.

7. The method of claim 1 wherein the substrate is lithographic aluminum comprising a textured surface.

8. A lithographic printing member comprising a hydrophilic metal substrate and, thereover, first and second layers, wherein (i) the first layer has a thickness and an exposure surface and comprises a material that absorbs imaging radiation, and (ii) the second layer overlies the first layer and is oleophilic and substantially transparent to imaging radiation, wherein the first layer is characterized by being subject to formation of an interior split within the thickness of the first layer in response to exposure to a predetermined imaging pulse, thereby facilitating removal, by subjection to the a cleaning liquid, of the second layer and the first layer above the interior split.

9. The member of claim 8 wherein the absorbing material is a pigment.

10. The member of claim 8 wherein the absorbing material is a dye.

11. The member of claim 8 wherein the absorbing material is a conductive polymer.

12. The member of claim 8 wherein the first layer comprises a polyvinyl alcohol chemical species.

13. The member of claim 8 wherein the substrate is lithographic aluminum comprising a textured surface.

* * * * *